United States Patent [19]

Maintok

[11] Patent Number: 4,473,032

[45] Date of Patent: Sep. 25, 1984

[54] STEAM GENERATOR WITH CIRCULATING ATMOSPHERE OR PRESSURIZED TURBULENT LAYER FIRING, AND METHOD FOR CONTROL THEREOF

[75] Inventor: Karl-Heinz Maintok, Oberhausen, Fed. Rep. of Germany

[73] Assignee: Deutsche Babcock Anlagen AG, Oberhausen, Fed. Rep. of Germany

[21] Appl. No.: 577,322

[22] Filed: Feb. 8, 1984

Related U.S. Application Data

[63] Continuation of Ser. No. 392,355, Jun. 25, 1982, abandoned.

[30] Foreign Application Priority Data

Jul. 1, 1981 [DE] Fed. Rep. of Germany ..... 3125849

[51] Int. Cl.[3] ..... F22B 1/02

[52] U.S. Cl. ..... 122/4 D; 110/243

[58] Field of Search ..... 110/234; 431/7; 122/4 D, 7 R

[56] References Cited

U.S. PATENT DOCUMENTS

| | | | |
|---|---|---|---|
| 3,682,139 | 8/1972 | Sahm | 110/234 X |
| 4,111,158 | 9/1978 | Reh et al. | 110/243 X |
| 4,165,717 | 8/1979 | Reh et al. | 431/7 X |

*Primary Examiner*—Henry C. Yuen

*Attorney, Agent, or Firm*—Max Fogiel

[57] ABSTRACT

The total evaporator heating surface of a steam generator with circulating atmospheric or pressurized turbulent layer firing is distributed over several partial surfaces which are arranged in a turbulence-type combustion chamber (1) in a flow-bed cooler (7) or in a waste-heat steam generator (9). The partial surface through which flow takes place first, is dimensioned for the required low-load operation of the steam generator. The steam generator is so regulated that during increasing load of the steam generator the flow-bed cooler (7) receives an increasing quantity of solids, and during sinking load it receives a decreasing quantity of solids.

6 Claims, 2 Drawing Figures

Figure 1:
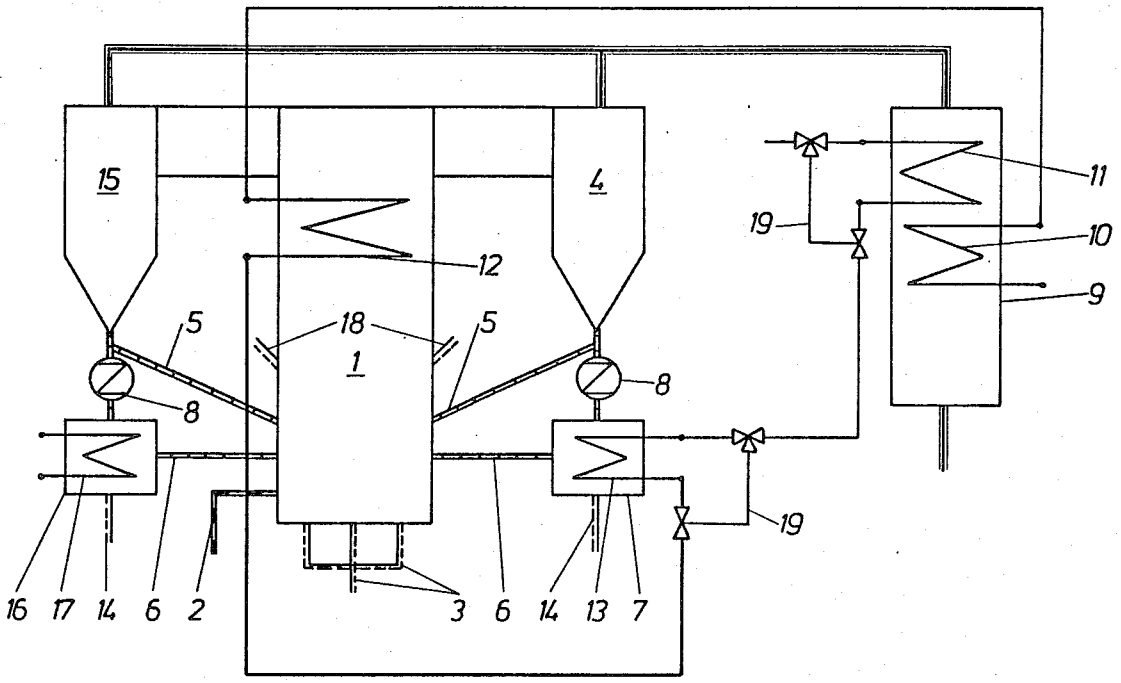

STEAM GENERATOR WITH CIRCULATING ATMOSPHERE OR PRESSURIZED TURBULENT LAYER FIRING, AND METHOD FOR CONTROL THEREOF

This application is a continuation of U.S. Ser. No. 392,355, filed June 25, 1982, now abandoned.

The invention relates to a steam generator with circulating atmospheric or pressurized turbulent layer firing consisting of a turbulence-type combustion chamber, flowing-bed coolers and waste-heat steam generator, in which feed-water pre-warmer-, evaporator- and superheater as well as intermediate-super-heater surfaces are arranged, the entire evaporator heat surface being distributed over several partial surfaces of which at least one is arranged in the flow cooler and/or in the turbulence-type combustion chamber, as well as a method for the control thereof.

Methods for carrying out processes in a circulating atmospheric turbulent layer are known, for example, from DE-AS No. 2,539,546 and DE-OS No. 2,624,302. They offer the advantage that in addition to the combustion smoke gases a second heat-carrier medium—which is the internally and externally circulating bed material—is available for heat-transmission purposes.

In a steam generator with a circulating turbulence layer under atmospheric pressure the entire evaporator heating surface is arranged in the turbulence-type combustion chamber, the super-heaters are arranged in the waste-gas steam generator which adjoins the turbulence-type combustion chamber at the gas side, the intermediate super-heaters and the feed-water preheater as well as the further super-heaters and intermediate super-heaters are arranged in the flowable bed coolers (VGB Kraftwerkstechnik (60) 1980, pages 366–376, FIG. 12).

The invention begins with a steam generator of the type mentioned in the introduction. The purpose of the invention is to improve this steam generator through a special construction of the evaporator, which permits an advantageous regulation of the evaporator.

In accordance with the invention this problem is solved in that the surface portion of the evaporator heating surface through which flow takes place first at the tube side, is sized for the required low-load of the steam generator.

In a steam generator constructed in this manner a regulation is possible in such a way, that during increasing load the heating surfaces arranged in the flow-bed coolers receive an increasing quantity—and during decreasing load receive a decreasing quantity—of solid medium which is being circulated and comes out of the turbulent layer. The heating surfaces of the inventive steam generator may have medium flow-through according to the natural circulation principle, the forced-circulation principle or the forced pass-through principle. The construction and distribution of the evaporator heating surfaces are such, that cooling and stability of the flow are guaranteed and that temperature gradients due to disadvantageous distribution of the water/steam mixture are avoided.

The advantages connected with the invention reside in that lowest partial loads of the steam generator are possible. The steam generator can be well regulated, due to the separation of the total evaporator heating surface into two or more partial heating surfaces. Possible deviation in the heat absorption of the evaporator heating surfaces can be readily corrected, in that either the supply of solid medium to the flow-bed cooler is subsequently varied, or in that the readily accessible heating surfaces in the flow-bed cooler are increased or decreased.

Several embodiments of the invention are illustrated in the drawing and are explained in more detail hereafter.

Figure 2:
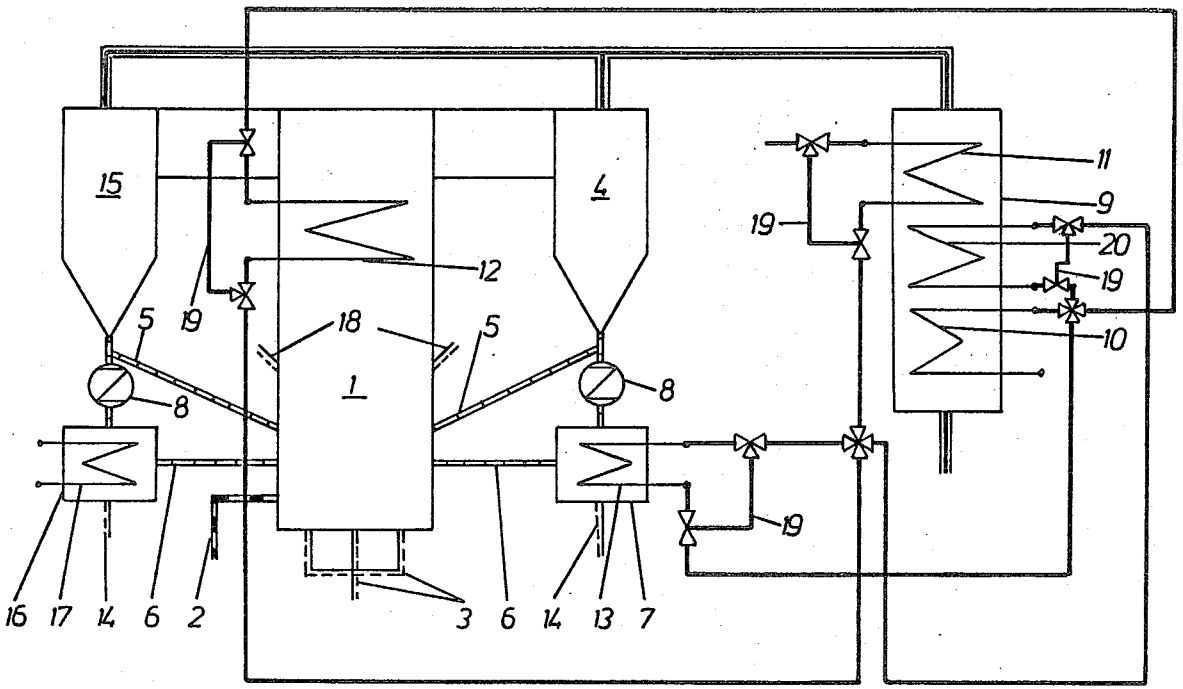

FIGS. 1 and 2 show the installation of a respective inventive steam generator with circulating turbulent layer firing.

The steam generator includes a turbulence-type combustion chamber 1, which receives a coal/lime mixture via a line 2, and primary combustion air via bottom nozzles 3 or lateral admission. The coal/lime mixture may also be directly admitted with the aid of a primary air stream. The addition of secondary combustion air takes place above the mixture-introduction, via lateral nozzles 18.

The solids carried out of the turbulence-type combustion chamber 1 with the gas, i.e. essentially ash, are separated in a return cyclone 4. Two solid lines 5 and 6 connected in parallel are also connected to the return cyclone 4 and open into the turbulence-type combustion chamber 1. Provided in the one solids line 6 is a flow-bed cooler 7, and a regulating device 8 is arranged ahead of the solids entry of this cooler. The separated solids are supplied to the turbulence-type combustion chamber 1 either directly via the solids line 5 or via the flow-bed cooler 7. The regulating device can be used to adjust the solids quantity which flows through the flow-bed cooler 7.

The gas exiting from the return cyclone 4 is supplied to a further (not illustrated) separator and, after flowing therethrough, is supplied to a waste-heat steam generator 9. Feed-water pre-heaters 10 and super-heaters 11 are arranged in the waste-heat steam generator as post-heating surfaces.

According to FIG. 1 the total evaporator heating surface of the steam generator is divided in two partial surfaces, of which one is accommodated as the heating surface 13 in the flow-bed cooler 7 and the other as the heating surface 12 in the turbulence-type combustion chamber 1. This heating surface 12 may be constructed as a bundled heating surface which dips into the turbulence layer. The heating surface 12 may be constituted by the cooled tube walls of the turbulence-type combustion chamber.

According to FIG. 1 the heating surface 12 arranged in the turbulence-type combustion chamber 1 is connected as the first evaporator and coupled with the feed-water pre-heater 10. The size of the partial evaporator heating surface through which flow first takes place, i.e. of the heating surface 12, is so calculated with reference to the required low-load of the steam generator, that cooling and stability are assured and temperature gradients due to disadvantageous distribution of the water/steam mixture in the tubes of heating surface 12 are avoided. Under low-load conditions the necessary evaporating energy is transmitted solely via the heating surface 12.

The heating surface needed for full load beyond the needs for low load, is accommodated in the flow-bed cooler 7 as the heating surface 13. The heating surface 13 may be a tube bundle or be constructed as a gas-tightly welded tube wall. The size of this heating surface 13 can be decreased or increased in a simple manner, by removal or addition of heating surface area. In low-load conditions flow takes place through the heating surface 13 in the flow-bed cooler 7, without heat being transmitted. By the use of bypass-lines 19 the evaporator heating surfaces may be modified independently of one another. The steam generated in the heating surface 12 of the turbulence-type combustion chamber 1 enters the super-heater 11 after flowing through the heating surface 13 of the flow-bed cooler 7. The thus super-heated steam is then supplied to a not illustrated high-pressure turbine.

In its bottom the flow-bed cooler 7 is provided with a connection 14 for the admission of a fluidizing gas. The solid matter entering the flow-bed cooler 7 when the regulating device 8 is open, is fluidized by the gas and can transfer its heat to the heating surface 13. The heat to be transferred to the heating surface 13 is regulated by the quantity of solid matter, in that during rising load the solids quantity is increased and during the decreasing load the solids quantity is reduced. This allows all ranges between low load and full load to be selected.

According to FIG. 1 the heating surfaces 12, 13 of the evaporator are connected in series. This series connection is used if the steam generator is operated in accordance with the forced pass-through principle.

FIG. 2 shows the same steam generator, but in this instance the partial evaporator heating surfaces are connected in parallel. This parallel connection will be used particularly if the steam generator is operated in accordance with the natural circulation principle or in accordance with the formed circulation principle.

FIG. 2 also shows the eventuality that a further partial evaporator heating surface is provided in the waste-heat steam generator as heating surface 20. This possibility is to be considered especially if a low-caloric coal is being burned in the turbulence-type combustion chamber 1. Under inclusion of this heating surface 20, and assuming the presence of two partial evaporator heating surfaces, these may—in addition to the possibility shown in FIG. 1—also be arranged in the turbulence-type combustion chamber 1 and the waste-heat steam generator 9 or in the cooler 7 and the waste-heat steam generator 9. It is also possible to provide three partial evaporator heating surfaces and to arrange one each in the turbulence-type combustion chamber 1, the cooler 7 and the waste-heat steam generator 9.

A further return cyclone 15 with solids lines 5 and 6 is arranged symmetrically with reference to the already described return cyclone 4. The solids separated in the further cyclone 15 are supplied to a second flow-bed cooler 16 which is operated independently of the described flow-bed cooler 7. The heating surfaces for a simple or dual super-heater 17 may be arranged in the second flow-bed cooler 16. The temperature of the steam which undergoes intermediate super-heating, is regulated solely by the quantity of solids supplied. The temperature regulation necessary is conventional steam generators, by injecting water into the steam, can be eliminated in this manner.

The invention has been described with reference to a circulating atmospheric turbulent-layer firing system. It can, however, also be used for a circulating pressurized turbulent-layer firing system.

I claim:

1. Steam generator with circulating atmospheric or pressurized fluidized bed furnace, comprising: a turbulence-type combustion chamber; flow-bed coolers and waste-heat steam generator; feed-water pre-heater surfaces, evaporator surfaces, super-heater surfaces and intermediate super-heater surfaces arranged in said fluidized bed furnace; said evaporator surfaces being distributed over a plurality of partial surfaces arranged in a flow-bed cooler or in said turbulence-type combustion chamber, a partial surface having flow therethrough taking place first at the tube side and being dimensioned for required low-load condition of the steam generator, said partial surface being heated only when said steam generator is operated at said low-load condition whereby the other partial surfaces can be bypassed; during rising load heating surfaces arranged in the flow-bed coolers being supplied with an increasing quantity of turbulence-layer solids and during falling load said heating surfaces being supplied with a decreasing quantity of turbulence-layer solids, said evaporator surfaces being feee of temperature radiants due to nonuniform distribution of water and steam mixture, said steam generator having means for being operable at minimum partial loads, deviations in heat absorption of the evaporator heating surfaces being correctable by means varying the supply of solid medium to the flow-bed cooler.

2. Steam generator according to claim 1, wherein a further partial surface of the evaporator heating surfaces is arranged in said waste-heat steam generator.

3. Steam generator according to claim 1, wherein said partial surfaces are connected in series at their tubes during operation of the steam generator according to forced passage principle.

4. Steam generator according to claim 1, wherein said partial surfaces are connected in parallel at their tubes during operation of the steam generator according to natural circulation principle or forced circulation principle.

5. Apparatus according to claim 1, including a blockable bypass line in parallel with each of said partial surfaces.

6. Steam generator according to claim 1, wherein one of the flow-bed coolers has heating surfaces for a simple or a dual intermediate super-heater.

* * * * *